US011358010B1

(12) United States Patent
Rusin

(10) Patent No.: US 11,358,010 B1
(45) Date of Patent: Jun. 14, 2022

(54) MASK CLIP ASSEMBLY WITH A HOUSING HAVING AN EXHAUST PORT AND ONE-WAY VALVE

(71) Applicant: Cliff R. Rusin, Newport Beach, CA (US)

(72) Inventor: Cliff R. Rusin, Newport Beach, CA (US)

( * ) Notice: Subject to any disclaimer, the term of this patent is extended or adjusted under 35 U.S.C. 154(b) by 0 days.

(21) Appl. No.: 17/220,557

(22) Filed: Apr. 1, 2021

(51) Int. Cl.
*A62B 9/02* (2006.01)
*A41D 13/11* (2006.01)
*A62B 7/10* (2006.01)
*A62B 23/02* (2006.01)

(52) U.S. Cl.
CPC ..... *A62B 9/02* (2013.01); *A41D 13/11* (2013.01); *A62B 7/10* (2013.01); *A62B 23/025* (2013.01)

(58) Field of Classification Search
CPC .... A62B 9/00; A62B 9/02; A62B 7/00; A62B 7/10; A62B 23/00–025; A41D 13/11
See application file for complete search history.

(56) References Cited

U.S. PATENT DOCUMENTS 3,751,793 A * 8/1973 Davis ..... B63H 9/067 29/523
4,469,097 A * 9/1984 Kelman ..... A62B 7/02 128/205.22
5,709,204 A * 1/1998 Lester ..... A62B 7/10 128/205.25
2001/0029952 A1* 10/2001 Curran ..... B01D 46/4272 128/206.17
2007/0283964 A1* 12/2007 Gorman ..... A62B 23/025 128/206.29
2007/0289592 A1* 12/2007 Sutton ..... A62B 23/02 128/201.24
2010/0101584 A1* 4/2010 Bledstein ..... A62B 18/10 128/863

(Continued)

*Primary Examiner* — Rachel T Sippel
*Assistant Examiner* — Jacqueline M Pinderski
(74) *Attorney, Agent, or Firm* — Stetina Brunda Garred & Brucker

(57) ABSTRACT

There is provided a mask clip assembly for use with a face mask. The assembly includes a housing having inner and outer housing shells. The housing has open and closed positions. In the closed position the inner and outer housing shells are engaged with each other and form a cavity between the inner and outer housing shells. In the open position the inner and outer housing shells are separated and disposed away from each other in comparison to the closed position, the housing being sized and configured to engage the face mask with a portion of a mask periphery disposed in the cavity with the housing in the closed position. The assembly includes an air filter and intake and exhaust ports. The assembly includes an intake tube attached to the housing and in fluid communication between the housing and the intake port. The intake tube is positionable adjacent an inner face mask side with the housing in the closed position with a portion of the mask periphery disposed in the cavity. The assembly includes a one-way valve that is configured to prevent fluidic flow from the exhaust port through the housing to the intake tube. The assembly includes a fluidic path extending into the intake port through the intake tube, the air filter, the cavity and the one-way valve and out of the exhaust port with the housing in the closed position.

16 Claims, 5 Drawing Sheets

(56) References Cited

U.S. PATENT DOCUMENTS

| | | | | |
|---|---|---|---|---|
| 2014/0305440 | A1* | 10/2014 | Root | A61M 16/0468 128/207.16 |
| 2015/0174435 | A1* | 6/2015 | Jones | A62B 23/025 128/202.13 |
| 2018/0280738 | A1* | 10/2018 | Gabriel | A62B 18/025 |

* cited by examiner

MASK CLIP ASSEMBLY WITH A HOUSING HAVING AN EXHAUST PORT AND ONE-WAY VALVE

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a filtered face masks. More particularly, the present disclosure relates to a mask clip assembly with a housing having an exhaust port and one-way valve.

2. Related Art

The use of face masks as a device for filtering inhaled air and mitigating spread of exhaled respiratory droplets have become prevalent in contemporary society. Such filtering face masks include a main face covering portion that covers the mouth and nose of the user. This can be as simple as a cotton cloth bandana tied around the head of the user. In other arrangements the main face covering portion may be concave shaped and molded to the general contours of a person's face so that the periphery of the covering portion seals against the face of the user. Straps may be used to attach the covering portion to the user's head and typically by looping about each ear of the user or by extending about the back of the head of the user. Such straps further seal and engage the covering portion against the user's face. When the user inhales, air is drawn through the coving portion into the confined gap between the inner side of the covering portion and the face of the user.

Prolonged use of a face mask often results in a high degrees of humidity and heat build-up in the confined gap at the user's face as result of the user's exhaled breath. This may result in the user enduring significant discomfort. Further, the user may experience excessive sweating around the mouth and nose. Additionally, this situation may induce difficulty in breathing, especially upon exertion. The face mask material may become wet and result in skin irritation.

In view of the foregoing, there is a need in the art for an improved face mask configuration.

BRIEF SUMMARY

In accordance with one embodiment, there is provided a mask clip assembly for use with a face mask. The face mask has inner and outer face mask sides and a mask periphery. The assembly includes a housing having inner and outer housing shells. The housing has open and closed positions. In the closed position the inner and outer housing shells are engaged with each other and form a cavity between the inner and outer housing shells. In the open position the inner and outer housing shells are separated and disposed away from each other in comparison to the closed position. The housing is sized and configured to engage the face mask with a portion of the mask periphery disposed in the cavity with the housing in the closed position. The assembly further includes an air filter. The assembly further includes an intake port. The assembly further includes an intake tube attached to the housing and in fluid communication between the housing and the intake port. The intake tube is positionable adjacent the inner face mask side with the housing in the closed position with a portion of the mask periphery disposed in the cavity. The assembly further includes an exhaust port. The assembly further includes a one-way valve disposed in the housing. The one-way valve is configured to prevent fluidic flow from the exhaust port through the housing to the intake tube. The assembly further includes a fluidic path extending into the intake port through the intake tube, the air filter, the cavity and the one-way valve and out of the exhaust port with the housing in the closed position.

According to various embodiments, the housing may further have a hinge connecting the inner and outer housing shells, and the hinge may be configured to flex upon the housing moving between the open and closed positions. The hinge and the inner and outer housing shells may be formed of a unitary contiguous piece of material. The hinge and the inner and outer housing shells may be formed of a plastic material. The inner housing shell may include an inlet formed therein, and the inlet may be disposed opposite to where the hinge is connected to the inner housing shell. The inner housing shell may include a set of inner teeth and the outer housing shell may include a set of outer teeth, and the inner teeth may be configured to face towards the outer teeth with the housing in the closed position. The inner teeth and the outer teeth may be configured to longitudinally overlap with each other with the housing in the closed position. The housing may include a latch, and the latch may be configured to engage the inner and outer housing shells with each other with the housing in the closed position. The inner housing shell may include an inlet formed therein, and the intake tube may be attached to the housing at the inlet. The inlet may be disposed in fluid communication between the intake tube and the cavity with the housing in the closed position. The inner housing shell may include an inner chamber and a valve opening. The inner chamber may be disposed in fluid communication between the inlet and the cavity through the valve opening.

In addition, the one-way valve may be disposed at the valve opening. The one-way valve may be a flexible diaphragm. The inner housing shell may include a set of inner teeth and the outer housing shell includes a set of outer teeth, and the inner teeth may be configured to face towards outer teeth with the housing in the closed position. The inner teeth and the outer teeth may be configured to longitudinally overlap with each other with the housing in the closed position. The inner and outer housing shells may be generally flat and may be disposed parallel to each other with the housing in the closed position. The intake tube may include a main section and a mouthpiece section, and the main section may be disposed between the housing and the mouthpiece section, the mouthpiece section includes the intake port. The main section and the mouthpiece section may be telescopically engaged with each other. The air filter may be disposed in the intake tube. The exhaust port may be disposed through the housing, and may be disposed through the outer housing shell.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
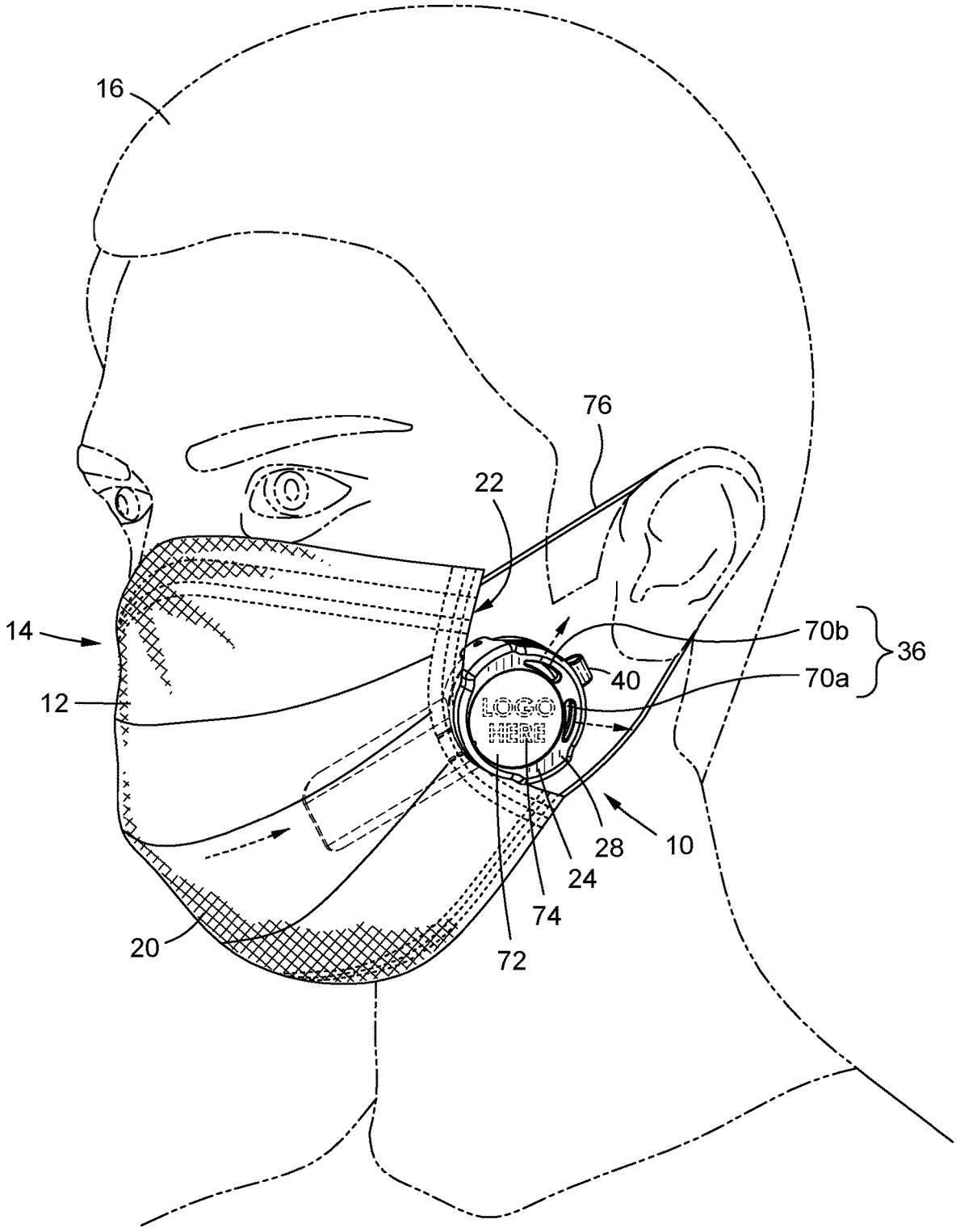
FIG. 1 is a perspective view of a user (in dashed lining) with a face mask and an attached a mask clip assembly according to an embodiment of the invention.
Figure 2:
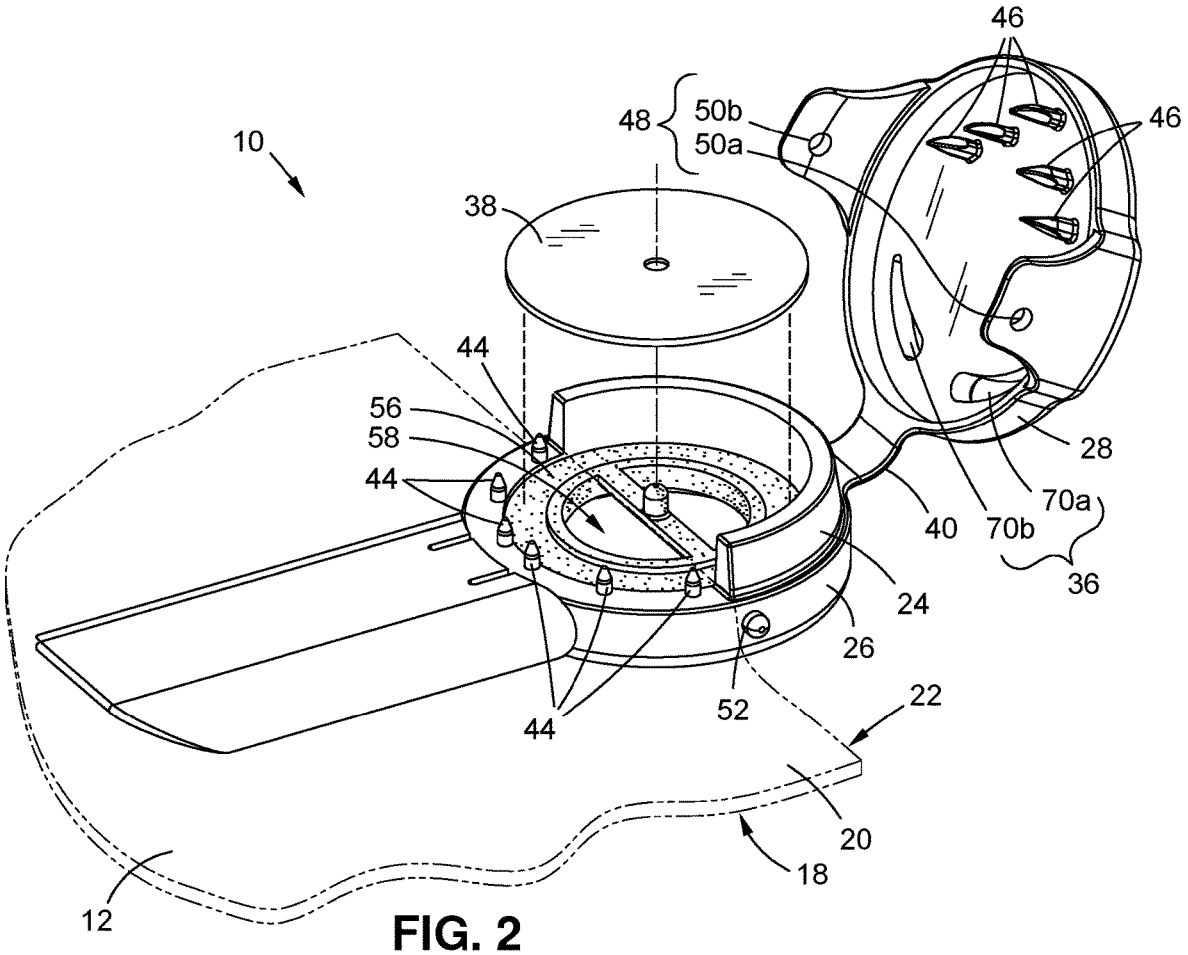
FIG. 2 is an enlarged top perspective view of the mask clip assembly of FIG. 1 in an open position as shown with a portion of the face mask (in dashed lining) and with a diaphragm valve depicted as exploded from the mask clip assembly.

Referring now to FIG. 1 there is depicted a perspective view of a user 16 (in dashed lining) wearing a face mask 12 upon a face 14 of the user 16 and an attached a mask clip assembly 10 according to an embodiment of the invention. According to an embodiment, there is provided the mask clip assembly 10 for use with the face mask 12. The face mask has inner and outer face mask sides 18, 20 and a mask periphery 22 disposed around and between the inner and outer face mask sides 18, 20. The assembly 10 includes a housing 24 having inner and outer housing shells 26, 28. The housing 24 has open and closed positions.

Figure 3:
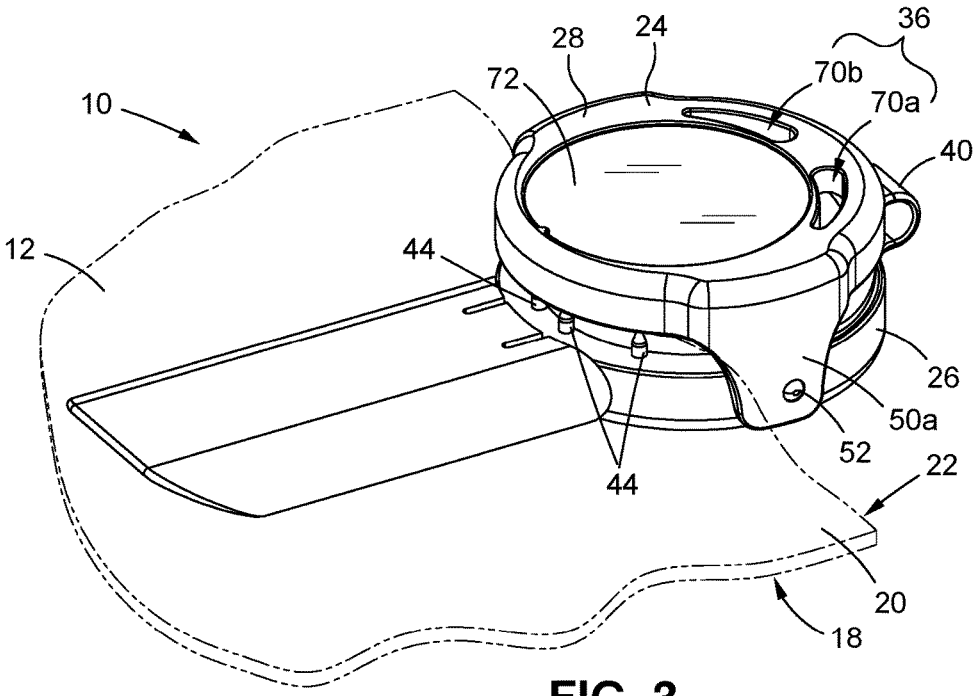
FIG. 3 is an enlarged top perspective view of the mask clip assembly of FIG. 2 in a closed position.
Figures 4, 5:
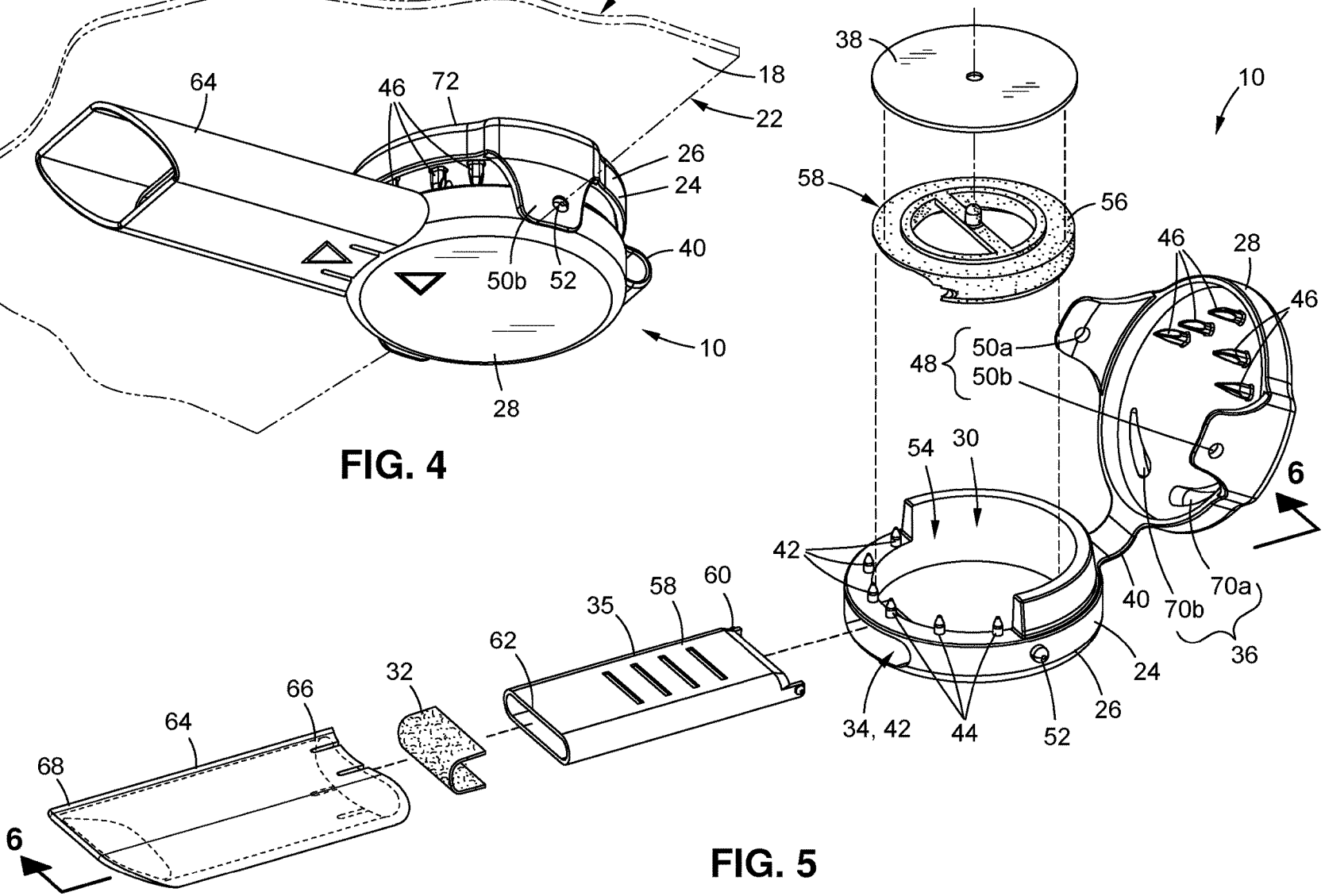
FIG. 4 is an enlarged bottom perspective view of the mask clip assembly of FIG. 3.
FIG. 5 is an enlarged exploded top perspective view of the mask clip assembly of FIG. 2 in the open position.
Figure 6:
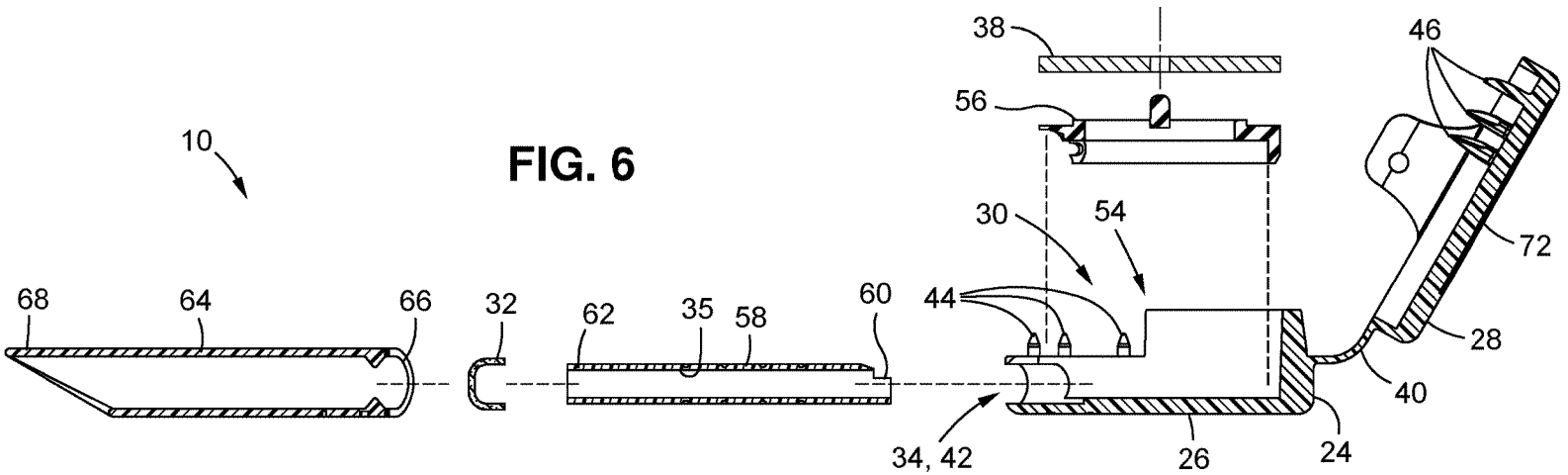
FIG. 6 is an enlarged exploded cross sectional side view of the mask clip assembly of FIG. 5.
Figure 7:
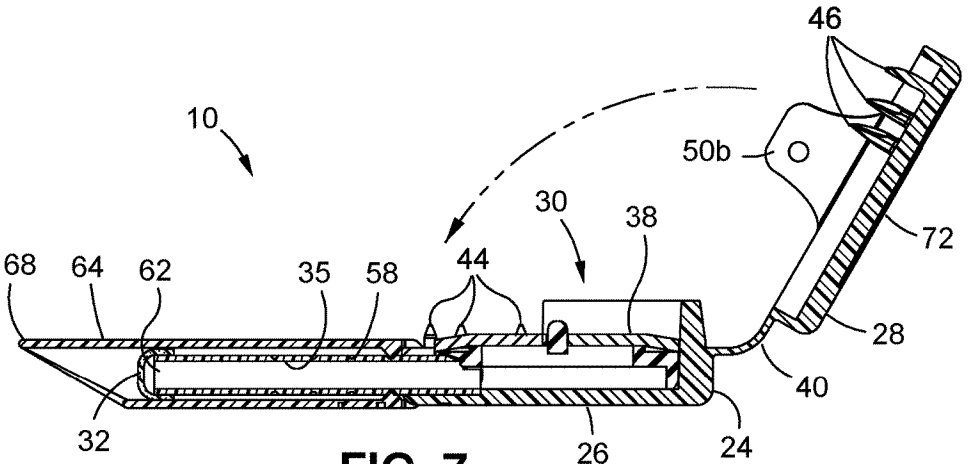
FIG. 7 is an enlarged cross sectional side view of the mask clip assembly of FIG. 6.
Figure 8:
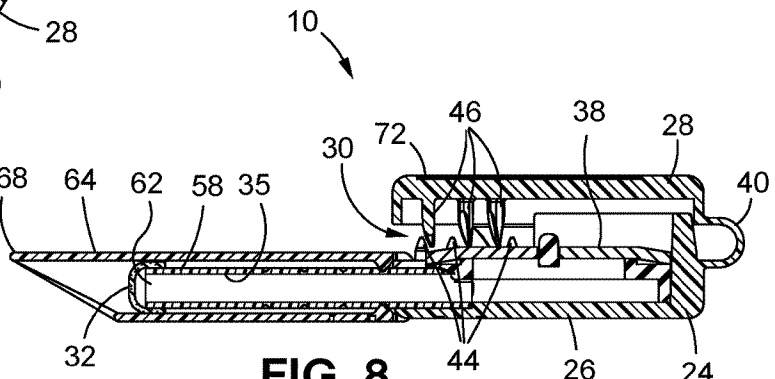
FIG. 8 is an enlarged cross sectional side view of the mask clip assembly of FIG. 7 in the closed position.

Referring additionally to FIGS. 2-8, FIG. 2 is an enlarged top perspective view of the mask clip assembly 10 of FIG. 1 in the open position and FIG. 3 is an enlarged top perspective view of the mask clip assembly 10 in a closed position. FIG. 4 is an enlarged bottom perspective view of the mask clip assembly 10 of FIG. 3. FIG. 5 is an enlarged exploded top perspective view of the mask clip assembly 10 of FIG. 2 in the open position, and FIG. 6 is an enlarged exploded cross sectional side view of the mask clip assembly 10 of FIG. 5. FIG. 7 is an enlarged cross sectional side view of the mask clip assembly 10 of FIG. 6, and FIG. 8 is an enlarged cross sectional side view of the mask clip assembly 10 of FIG. 7 in the closed position.

In the closed position the inner and outer housing shells 26, 28 are engaged with each other and form a cavity 30 between the inner and outer housing shells 26, 28. In the open position the inner and outer housing shells 26, 28 are separated and disposed away from each other in comparison to the closed position. The housing 24 is sized and configured to engage the face mask 12 with a portion of the mask periphery 22 disposed in the cavity 30 with the housing 24 in the closed position. The assembly 10 further includes an air filter 32. The assembly 10 further includes an intake port 34. The assembly 10 further includes an intake tube 35 attached to the housing 24 and in fluid communication between the housing 24 and the intake port 34. The intake tube 35 is positionable adjacent and generally parallel to the inner face mask side 18 with the housing 24 in the closed position with a portion of the mask periphery 22 disposed in the cavity 30. The assembly 10 further includes an exhaust port 36. The assembly 10 further includes a one-way valve 38 disposed in the housing 24. The one-way valve 38 is configured to prevent fluidic flow from the exhaust port 36 through the housing 24 to the intake tube 35. The assembly 10 further includes a fluidic path extending into the intake port 34 through the intake tube 35, the air filter 32, the cavity 30 and the one-way valve 38 and out of the exhaust port 36 with the housing 24 in the closed position.

As mentioned above, in the closed position the inner and outer housing shells 26, 28 are engaged with each other and form a cavity 30. In this regard, the inner and outer housing shells 26, 28 do not need to directly touch each other. Rather, all that is required is that portion of the inner and outer housing shells 26, 28 being in close proximity. This allows the outer housing shell 28 to be engaged against the outer face mask side 20 and the inner housing shell 26 to be engaged against the inner face mask side 18 so as to capture the face mask 12 between the inner and outer housing shells 26, 28. The inner and outer housing shells 26, 28 are configured to facilitate the housing 24 to clip onto the face mask 12 with the housing 24 in the closed position.

As mentioned above, in the open position the inner and outer housing shells 26, 28 are separated and disposed away from each other in comparison to the closed position. In the open position the inner and outer housing shells 26, 28 are configured to allow the face mask 12 to be inserted between the inner and outer housing shells 26, 28 by laterally translating the mask periphery 22 into the open space between the inner and outer housing shells 26, 28. Once in such position, the housing 25 can then be moved into the closed position to clip the housing 24 to the face mask 12. The face mask 12 may further include a pair of ear straps 76. The mask clip assembly 10 may be attached to the face mask 12 between an ear strap 76. However, it is recognized that the mask clip assembly 10 may be attached a various positions along the mask periphery 22 as desired.

According to various embodiments, the housing 24 may further have a hinge 40 connecting the inner and outer housing shells 26, 28. The hinge 40 may be configured to flex upon the housing moving between the open and closed positions. In the embodiment depicted, the hinge 40 and the inner and outer housing shells 26, 28 may be formed of a unitary contiguous piece of material. As such the hinge 40 and the inner and outer housing shells 26, 28 may be formed of a plastic material. Such plastic material may have some degree of flexibility so as to the allow the hinge 40 to bend to allow the housing 24 to move between the open and closed positions in a clamshell-like motion. It is contemplated that the hinge 40 may be formed as a separate component that is attached to each of the inner and outer housing shells 26, 28. Further, the hinge 40 may be integrally formed with just the inner housing shell 26 or the outer housing shell 28.

The inner housing shell 26 may include an inlet 42 formed therein. In this regard the inlet port 34 may take the form of the inlet 42. The inlet 42 may be disposed opposite to where the hinge 40 is connected to the inner housing shell 26.

The inner housing shell 26 may include a set of inner teeth 44 and the outer housing shell 28 includes a set of outer teeth 46, and the inner teeth 44 may be configured to face towards the outer teeth 46 with the housing 24 in the closed position. The inner teeth 44 are arrayed along an opposite side of the inner housing shell 26 from where the hinge 40 is attached to the inner housing shell 26. Similarly, the outer teeth 46 are arrayed along an opposite side of the outer housing shell 28 from where the hinge 40 is attached to the outer housing shell 28. The inner and outer teeth 44, 46 may be respectively integrally formed with the inner and outer housing shells 26, 28. The inner teeth 44 and the outer teeth 46 may have pointed ends so as to facilitate engagement with the face mask 12, and may be configured to puncture the face mask 12 if so desired. Further, the inner teeth 44 and the outer teeth 46 may be configured to longitudinally overlap with each other with the housing 24 in the closed position. In this regard, the inner and outer teeth 44, 46 may be configured to firmly grasp the face mask 12 with the inner and outer housing shells 26, 28 capturing the face mask 12 in a biting configuration in the closed position. It is contemplated that the sizing, shape, number, configuration, and degree of overlap and separation while the housing 24 is in the closed position of the inner and outer teeth 44, 46 would being taken into consideration to adjust for the desired degree of sealing of the cavity 30 with the face mask 12 being captured between the inner and outer teeth 44, 46 so as to mitigate the amount of airflow that may pass into and out of the housing 24 at such location.

The housing 24 may include a latch 48. The latch 48 may be configured to engage the inner and outer housing shells 26, 28 with each other with the housing 24 in the closed position. In the embodiment depicted, the latch 48 is in the form of first and second latch portions 50*a, b* that respectively extend from the outer housing shell 28 towards the inner housing shell 26 with the housing 24 in the closed position. The first and second latch portions 50*a, b* may be respectively configured to releasably engage a catch 52 disposed on opposite side of the inner housing shell 26. The latch 48 and the catch 52 are configured to hold the housing 24 in the closed position.

The inner housing shell 26 includes an inner chamber 54 and a valve opening 58. The inner housing shell 26 may include a valve support 56. The valve support 56 is formed in the inner housing shell 26 and encloses the inner chamber 54. The valve opening 58 is formed in valve support 56. The inner chamber 54 may be disposed in fluid communication between the inlet 42 and the cavity 30 through the valve opening 58. The one-way valve 38 may be disposed at the valve opening 58 and supported by the valve support 56. In the embodiment depicted, the one-way valve 38 is a circular flexible diaphragm that is supported at its center by the valve support 56 and the periphery of the diaphragm is seated against the valve support 56. The one-way valve 38 operates by flexing in response to air pressure pushing upon the one-way valve 38 from the inner chamber 54. This flexing is with respect to a portion of the periphery of the diaphragm moving to become unseated from the valve support 56 to expose the valve opening 58 to the portion of space within the outer housing shell 28. Airflow passes from the inner chamber 54 past the one-way valve 38 and into the portion of the cavity 30 formed by the outer housing shell 28. The one-way valve 38 is configured to not allow airflow to pass from the portion of the cavity 30 formed by the outer housing shell 28 to the inner chamber 54. It is contemplated that the amount of pressure required to overcome of the one-way valve 38 would be considered in the context of the relative pressure required for airflow to pass through the face mask 12 during exhalation. The type and configuration of the one-way valve 38 may be chosen from those of one of ordinary skill in the art.

The intake tube 35 may be attached to the housing 24 at the inlet 42. As such, the inlet 42 is in fluid communication between the intake tube 35 and the cavity 30 with the housing 24 in the closed position. The air filter 32 may be disposed in the intake tube 35. The intake tube 35 may include a main section 58 and a mouthpiece section 64. The main section 58 is fitted to engage with the inlet 42. The main section 58 is disposed between the housing 24 and the mouthpiece section 64. The main section 58 includes the intake port 34. The main section 58 includes first end 60 and a second end 62. The first end 60 of the main section 58 is configured to be engaged with the inlet 42. This may be a snap-fit or press-fit connection for example. This holds and assembles the overall intake tube 35 with the housing 24. As is depicted, the air filter 32 is positioned within the intake tube 35 by being folded about the second end 62 of the main section 58. However, it is contemplated that the air filter 32 may be positioned at other locations along the intake tube 35 or even within the inner housing shell 26. The main section 58 with the folded air filter 32 is then press-fit into the mouthpiece section 64. The mouthpiece section 64 includes first end 66 and a second end 68. As such, the main section 58 with the folded air filter 32 is inserted though the first end 66 of the mouthpiece section 58. By folding the air filter 32 across the second end 62, this ensures that any airflow through the intake 35 will necessarily pass through the air filter 32. Further, this allows for a firm sealed attachment of the mouthpiece section 64 to the main section 58. The main section 58 and the mouthpiece section 64 may be telescopically engaged with each other. This allows the main section 58 and the mouthpiece section 64 to adjust the overall length of the intake tube 35 to accommodate for different sizing of various face masks 12 and as is desired by the user 16 for fit and comfort.

The exhaust port 36 may be disposed through the housing 24, and may be disposed through the outer housing shell 28. In the embodiment depicted, the exhaust port 36 may take the form of exhaust port sections 70*a, b*. The sizing, shape, number and positioning of exhaust port sections 70*a, b* may be chosen from those which are well known to one of ordinary skill in the art.

The inner and outer housing shells 26, 28 may be generally flat and may be disposed parallel to each other with the housing 24 in the closed position. The outer housing shell 28 may have a generally flat outer surface 72 that faces away from the inner housing shell 26. In this regard the outer surface 72 the exposed surface of housing 24 that faces away from the user's face 14 when the mask clip assembly 10 is worn. If so desired, indicia 74 may be disposed upon the outer surface 72.

In the normal course of wearing the face mask 12 with the mask clip assembly 10 attached to the face mask 12 with the housing 24 in the closed position, the airflow path is next discussed. When the user 16 inhales, a vacuum pressure is built up in the gap between the inner face mask side 18 and the face 14 of the user 16 in comparison to the ambient pressure outside of the outer face mask side 20. As the material forming the face mask 12 is configured to allow airflow to flow into and through the face mask 12, airflow is drawn through the face mask 12 adjacent the face 14 of the user 16 within the mask periphery 22 sealed against the face 14 of the user 16. It is noted that during such inhalation, airflow does not flow through the mask clip assembly 10 because the one-way valve 38 is particularly configured to mitigate against airflow in a direction from the exhaust port 36 through the housing 24.

When the user 16 exhales, a pressure is built up in the gap between the inner face mask side 18 and the face 14 of the user 16 in comparison to the ambient pressure outside of the outer face mask side 20. The configuration of the mask clip assembly 10 allows for airflow to pass through mask clip assembly 10. This alleviates the exhaled airflow to only be permitted to pass through the face mask 12. This results in a decreased heat and humidity build up and an overall lessening of the airflow resistance when exhaling as experienced by the user 16. Airflow passes into the second end 68 of the mouthpiece section 58, through the mouthpiece section 64, and out the first end 66. With the mouthpiece section 64 assembled with the main section 58, airflow continues through the second end 62, through the main section 58 and the air filter 32 positioned therein, and out the first end 60. As the first end 60 is engaged with the inlet 42 of the inner housing shell 26, the airflow passes through the inlet 42 and into the inner chamber 54 of the housing 24. The one-way valve 38 is configured to allow passage of airflow from the inner chamber 54 towards the outer housing shell 28. In this regard, the airflow continues through the valve opening 58 of the valve support 56 and the pressure of the airflow causes the one-way valve 38 to open to allow the airflow to pass into the portion of the cavity 30 between the one-way valve 38 and the interior of the outer housing shell 28. Finally, the airflow passes through the exhaust port 36 in the form of the exhaust port sections 70*a, b*. As such, with the forgoing described configuration, a fluidic airflow path is provided from the second end 68 of the mouthpiece section 58 to the exhaust portion sections 70*a, b* through the housing 24 without passing through the face mask 12.

It is contemplated that the mask clip assembly 10 may be attached at any portion of the mask periphery 22. It is contemplated that for comfort and fit considerations the mask clip assembly 10 would most likely be attached at a portion of the face mask 12 adjacent a side of the user's face 14, such as at one side of the user's face 14 between the ear straps 76 such as is depicted in the figures. Such a side placement in turn affect the direction of the exiting airflow from the mask clip assembly 10. Having this side installation has the benefit of directing the exiting airflow to the side of the user's face 14. This may mitigate spread of undesirable exhaled particulates directly in front of the user 16. Further, the air filter 32 may be selected so as to result in a higher degree of air filtering than in comparison to airflow just exiting the face mask 12. The air filter 32 may be selected based upon the desired degree of air filtering efficiency and particulate size, such as to be capable of filtering out airborne virus particles shed of the user 16 during exhalation.

Figure 9:
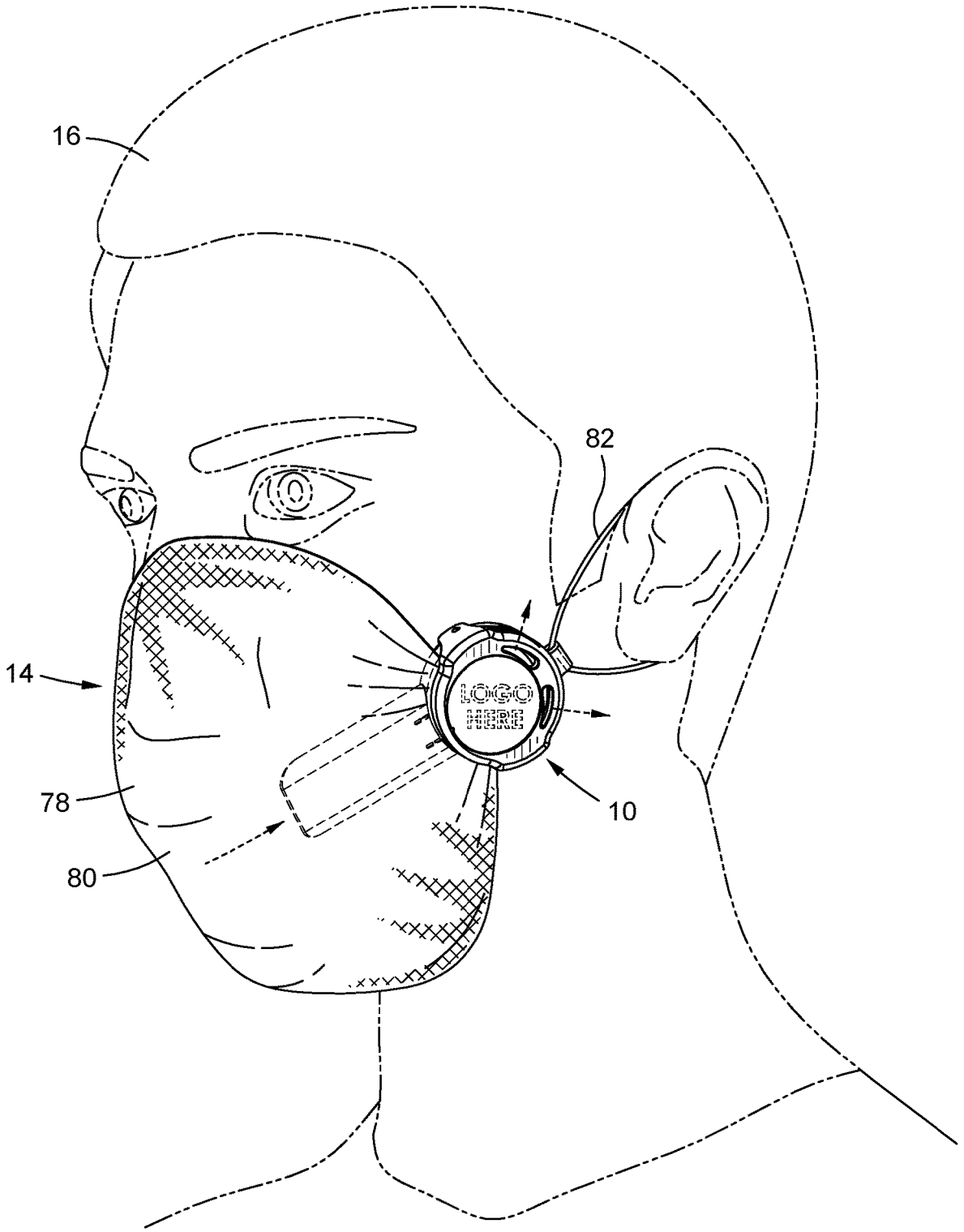
FIG. 9 is a mask clip assembly of FIG. 1 with mask material and an ear strap as worn by a user (in dashed lining) according to another embodiment.

Referring now to FIG. 9 there is depicted the mask clip assembly 10 as used with an alternate face mask 78. In this embodiment, the face mask 78 includes mask material 80. The mask material 80 may be as simple of as a folded handkerchief or bandana. A pair of ear straps 82 may be provided that may take the form of elastic bands or loops, such as a rubber band. The ear straps 82 may be looped about the hinge 40. In this regard two such mask clip assemblies 10 may be used (only one is depicted at the left side of the user's face 12 in FIG. 9). As such, a pair of the mask clip assemblies 10 with the mask material 80 and tow each straps 82 can be used to readily form the face mask 78.

The various components of the mask clip assembly 10, including the housing 24, the air filter 32, and the one-way valve 38, may have various shapes, surface textures and sizes and formed of various materials which are chosen from those which are well known to one of ordinary skill in the art. Further, the various components of the mask clip assembly 10, including the housing 24, the air filter 32, and the one-way valve 38, may be manufactured and assembled according to those techniques which are chosen from those which are well known to one of ordinary skill in the art.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A mask clip assembly for use with a face mask, the face mask having inner and outer face mask sides and a mask periphery disposed around and between the inner and outer face mask sides, the assembly comprising:

a housing having inner and outer housing shells, the housing having open and closed positions, in the closed position the inner and outer housing shells are engaged with each other and form a cavity between the inner and outer housing shells, in the open position the inner and outer housing shells are separated and disposed away from each other in comparison to the closed position, the housing being sized and configured to engage the face mask with a portion of the mask periphery disposed in the cavity with the housing in the closed position, the housing further having a hinge connecting the inner and outer housing shells, the hinge being configured to flex upon the housing moving between the open and closed positions, the inner and outer housing shells being generally flat and disposed parallel to each other with the housing in the closed position;

an air filter;

an intake port;

an intake tube attached to the housing and in fluid communication between the housing and the intake port, the intake tube positionable adjacent and generally parallel to the inner face mask side with the housing in the closed position with the portion of the mask periphery disposed in the cavity;

an exhaust port;

a one-way valve disposed in the housing, the one-way valve configured to prevent fluidic flow from the exhaust port through the housing to the intake tube; and a fluidic path extending into the intake port through the intake tube, the air filter, the cavity and the one-way valve and out of the exhaust port with the housing in the closed position at least partially without passing through the face mask.

2. The mask clip assembly of claim 1 wherein the hinge and the inner and outer housing shells are formed of a unitary contiguous piece of material.

3. The mask clip assembly of claim 1 wherein the hinge and the inner and outer housing shells are formed of a plastic material.

4. The mask clip assembly of claim 1 wherein the inner housing shell includes an inlet formed therein, the inlet is disposed opposite to where the hinge is connected to the inner housing shell.

5. The mask clip assembly of claim 1 wherein the inner housing shell includes a set of inner teeth and the outer housing shell includes a set of outer teeth, the inner teeth are configured to face towards the outer teeth with the housing in the closed position.

6. The mask clip assembly of claim 5 wherein the inner teeth and the outer teeth are configured to longitudinally overlap with each other with the housing in the closed position.

7. The mask clip assembly of claim 1 wherein the housing includes a latch, the latch is configured to engage the inner and outer housing shells with each other with the housing in the closed position.

8. The mask clip assembly of claim 1 wherein the inner housing shell includes an inlet formed therein, the intake tube is attached to the housing at the inlet, the inlet is in fluid communication between the intake tube and the cavity with the housing in the closed position.

9. The mask clip assembly of claim 8 wherein the inner housing shell includes an inner chamber and a valve opening, the inner chamber is in fluid communication between the inlet and the cavity through the valve opening.

10. The mask clip assembly of claim 9 wherein the one-way valve is disposed at the valve opening.

11. The mask clip assembly of claim 1 wherein the one-way valve is a flexible diaphragm.

12. The mask clip assembly of claim 1 wherein the intake tube includes a main section and a mouthpiece section, the main section is disposed between the housing and the mouthpiece section, the mouthpiece section includes the intake port.

13. The mask clip assembly of claim 12 wherein the main section and the mouthpiece section are telescopically engaged with each other.

14. The mask clip assembly of claim 1 wherein the air filter is disposed in the intake tube.

15. The mask clip assembly of claim 1 wherein the exhaust port is disposed through the housing.

16. The mask clip assembly of claim 15 wherein the exhaust port is disposed through the outer housing shell.

* * * * *